US007094745B2

(12) United States Patent
Jonas et al.

(10) Patent No.: US 7,094,745 B2
(45) Date of Patent: Aug. 22, 2006

(54) USE OF TRANSITION METAL COMPLEXES HAVING LACTAM LIGANDS AS BLEACHING CATALYSTS

(75) Inventors: Ekaterina Jonas, Bad Soden (DE); Gerd Reinhardt, Kelkheim (DE); Daniel Kewitz, Frankfurt (DE); Aylin Karadag, Frankfurt (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 10/954,425

(22) Filed: Sep. 30, 2004

(65) Prior Publication Data

US 2005/0181964 A1 Aug. 18, 2005

(30) Foreign Application Priority Data

Sep. 30, 2003 (DE) ..... 103 45 273

(51) Int. Cl.

| | |
|---|---|
| ***C11D 7/26*** | (2006.01) |
| ***C11D 7/32*** | (2006.01) |
| ***C11D 7/38*** | (2006.01) |
| ***C11D 7/54*** | (2006.01) |

(52) U.S. Cl. ..... 510/313; 510/303; 510/372; 510/376; 510/378; 510/501; 510/505; 252/186.39; 252/186.41; 502/200

(58) Field of Classification Search ..... None
See application file for complete search history.

(56) References Cited

U.S. PATENT DOCUMENTS

| | | | | |
|---|---|---|---|---|
| 5,853,428 | A | 12/1998 | Collins et al. | |
| 6,077,457 | A | 6/2000 | Friesen et al. | |
| 6,136,222 | A | 10/2000 | Friesen et al. | |
| 2002/0165110 | A1 | 11/2002 | Reinhardt et al. | |
| 2004/0127382 | A1* | 7/2004 | Kunz et al. | 510/376 |

FOREIGN PATENT DOCUMENTS

| | | |
|---|---|---|
| WO | WO95/30681 | 11/1995 |
| WO | WO97/07191 | 2/1997 |

* cited by examiner

*Primary Examiner*—Gregory R. Del Cotto
(74) *Attorney, Agent, or Firm*—Richard P. Silverman

(57) ABSTRACT

The use of compounds of the formula (1)

$$M(L)_nX_m \quad (1)$$

in which
M is a metal atom from the group consisting of Mn, Fe, Co, Ni, Mo and W,
L is a ligand from the group consisting of the cyclic carboxamides (lactams),
X is chloride, bromide, nitrate, perchlorate, citrate, hexafluorophosphate or anions of organic acids having $C_1$–$C_{22}$ carbon atoms and
n is a number from 2 to 4 and m is a number from 0 to 4, as catalysts for peroxygen compounds, in particular in detergents, bleaches and cleaning agents, is claimed.

12 Claims, No Drawings

USE OF TRANSITION METAL COMPLEXES HAVING LACTAM LIGANDS AS BLEACHING CATALYSTS

The present invention relates to the use of certain transition metal complex compounds for enhancing the bleaching effect of peroxygen compounds in the bleaching of stains both on textiles and on hard surfaces, and detergents and cleaning agents which contain such complex compounds.

Inorganic peroxygen compounds, in particular hydrogen peroxide and solid peroxygen compounds which dissolve in water with liberation of hydrogen peroxide, such as sodium perborate and sodium carbonate perhydrate, have long been used as oxidizing agents for disinfecting and bleaching purposes. The oxidation effect of these substances in dilute solution depends to a great extent on the temperature; thus, for example with $H_2O_2$ or perborate in alkaline bleaching liquors, sufficiently rapid bleaching of soiled textiles is achieved only at temperatures above about 80° C.

At lower temperatures, the oxidizing effect of the inorganic peroxygen compounds can be improved by adding bleach activators. Numerous proposals have been developed in the past for this purpose, especially from the classes of substances consisting of the N- or O-acyl compounds, for example polyacylated alkylenediamines, in particular tetraacetylglycoluril, N-acylated hydantoins, hydrazides, triazoles, hydrotriazines, urazoles, diketopiperazines, sulfurylamides and cyanurates, and also carboxylic anhydrides, in particular phthalic anhydride and substituted maleic anhydrides, carboxylic esters, in particular sodium nonanoyloxybenzenesulfonate (NOBS), sodium isononanoyloxybenzenesulfonate (ISONOBS) and acylated sugar derivatives, such as pentaacetylglucose. By adding these substances, the bleaching effect of aqueous peroxide solutions can be increased to such an extent that at temperatures as low as about 60° C. substantially the same effects occur as with the peroxide solution alone at 95° C.

In efforts relating to energy-saving washing and bleaching processes, application temperatures substantially below 60° C., in particular below 45° C. down to the temperature of cold water, have been increasing in importance in recent years. At these low temperatures, the effect of the activator compounds known to date generally declines noticeably. There has therefore been no lack of efforts to develop activators more effective for this temperature range, but without any convincing success having been achieved to date.

A starting point in this context arises through the use of transition metal salts and complex compounds thereof, as described, for example, in EP 0 392 592, EP 0 443 651, EP 0 458 397, EP 0 544 490 or EP 0 549 271. EP 0 272 030 describes cobalt(II) complexes having ammonia ligands, which moreover may have any desired further monodentate, bidentate, tridentate and/or tetradentate ligands, as activators for $H_2O_2$ for use in textile detergents or bleaches. WO 96/23859, WO 96/23860 and WO 96/23861 describe the use of corresponding Co(II) complexes in compositions for the automatic cleaning of dishes. EP 0 630 964 discloses certain manganese complexes which have no pronounced effect with regard to enhancement of bleaching by peroxygen compounds and do not decolorize colored textile fibers but which are capable of bleaching dirt or dye present in wash liquors and detached from the fiber. DE 44 16 438 discloses manganese, copper and cobalt complexes which may carry ligands from a multiplicity of groups of substances and are to be used as bleaching and oxidation catalysts. WO 97/07191 proposes complexes of manganese, of iron, of cobalt, of ruthenium and of molybdenum having ligands of the salen type of activators for peroxygen compounds in cleaning solutions for hard surfaces.

It is an object of the present invention to improve the oxidizing and bleaching effect of peroxygen compounds, in particular of inorganic peroxygen compounds, at low temperatures below 80° C., in particular in a temperature range from about 10° C. to 45° C. The metal complexes required for this purpose should be easily obtainable and simple to prepare.

Surprisingly, it has now been found that certain transition metal complexes having a simple composition and nitrogen-containing ligands make a substantial contribution to the cleaning performance with respect to stains which are present on textiles or on hard surfaces.

The invention relates to the use of transition metal complexes having nitrogen-containing ligands as bleaching catalysts, wherein the transition metal complexes have the formula (1)

$$M(L)_nX_m \quad (1)$$

in which

M is a metal atom from the group consisting of Mn, Fe, Co, Ni, Mo and W,

L is a ligand from the group consisting of the cyclic carboxamides (lactams),

X is chloride, bromide, nitrate, perchlorate, citrate, hexafluorophosphate or anions of organic acids having $C_1$–$C_{22}$ carbon atoms and n is a number from 2 to 4 and m is a number from 0 to 4.

These transition metal complexes are used in detergents and cleaning agents, in particular in the washing of textiles and in cleaning agents for hard surfaces, in particular for dishes, or in solutions for bleaching stains.

Complexes comprising transition metal central atoms in the oxidation states +2, +3 or +4, and complexes having manganese or iron as central atoms, are preferably used.

Examples of L are aliphatic lactams, such as optionally substituted azetidinones, butyrolactams (2-pyrrolidinone), gamma- and delta-valerolactams, epsilon-caprolactam, dodecanelactams, pyrrolones and 3-morpholones. A further important group of lactams comprises aromatic lactams. Examples of these are hydrocarbostyril, isohydrocarbostyril, benzopiperidone, naphthostyril and phenanthridone. The synthesis and properties of the lactams are described, inter alia, in "Methoden zur Herstellung und Umwandlung von Lactamen" [Methods for the preparation and conversion of lactams] in Houben-Weyl, Methoden der organischen Chemie [Methods of Organic Chemistry], 4th Edition, E. MUller (Ed.), Georg Thieme Verlag Stuttgart 1958, pages 511–585.

In particular, the halides, such as chloride, bromide and iodide, but also nitrate, citrate, perchlorate and complex anions, such as tetrafluoroborate and hexafluorophosphate, or anions of organic $C_1$–$C_{22}$-carboxylic acids, such as acetates, propionates, butyrates, hexanoates, octanoates, nonanoates and laurates, are used for the ligands X. The anion ligands ensure the charge equalization between transition metal central atom and the ligand system.

Suitable peroxygen compounds are primarily alkali metal perborate mono- or tetrahydrate and/or alkali metal percarbonate, sodium being the preferred alkali metal. However, alkali metal or ammonium peroxosulfates, such as, for example, potassium peroxomonosulfate (industrially: Caroat® or Oxone®), can also be used. The concentration of the inorganic oxidizing agents, based on the total formulation of the detergents and cleaning agents, is 5–90%, preferably 10–70%.

The amounts of peroxygen compounds used are in general chosen so that between 10 ppm and 10% of active oxygen, preferably between 50 ppm and 5 000 ppm of active oxygen, are present in the solution of the detergents and cleaning agents. The amount of bleach-enhancing complex compound used also depends on the purpose. Depending on the desired degree of activation, it is used in amounts such that from 0.01 mmol to 25 mmol, preferably from 0.1 mmol to 2 mmol, of complex per mole of peroxygen compound are used, but in particular cases it is also possible to exceed or fall below these limits. Detergents and cleaning agents preferably contain from 0.0025 to 1% by weight, in particular from 0.01 to 0.5% by weight, of the above-defined bleach-enhancing complex compound.

Additionally or alternatively, the detergents and cleaning agents may contain oxidizing agents based on organic substances in the concentration range of 1–20%. These include all known peroxycarboxylic acids, e.g. monoperoxyphthalic acid, diperoxydodecanedioic acid, phthalimidoperoxycarboxylic acids, such as PAP and related systems or the amidoperacids mentioned in EP-A 170 386.

Here, the term bleaching includes both the bleaching of dirt present on the textile surface and the bleaching of dirt detached from the textile surface and present in the wash liquor. For the bleaching of stains on hard surfaces, the same applies in context. Further potential applications are in the personal care sector, for example in the bleaching of hair and for improving the efficacy of denture cleaners. The metal complexes described are furthermore used in commercial laundries, in wood and paper bleaching, in the bleaching of cotton and in disinfectants.

The invention furthermore relates to a process for the cleaning of textiles as well as of hard surfaces, in particular of dishes, using said complex compounds together with peroxygen compounds in aqueous solution optionally containing further detergent or cleaning agent constituents, and detergents and cleaning agents for hard surfaces, in particular cleaning agents for dishes, those which contain such complex compounds being preferred for use in processes in machines.

In the case of hard surfaces contaminated with stains or in the case of soiled textiles, the use according to the invention substantially comprises creating conditions under which a peroxidic oxidizing agent and the complex compound can react with one another, with the aim of obtaining secondary products having a stronger oxidizing effect. Such conditions are present in particular when the reactants encounter one another in aqueous solution. This can occur as a result of separate addition of the peroxygen compound and of the complex to the aqueous solution of the detergent and cleaning agent. However, the process according to the invention is particularly advantageously carried out using a detergent or cleaning agent for hard surfaces which contains the complex compound and optionally a peroxygen-containing oxidizing agent. The peroxygen compound can also be added separately as such or preferably as an aqueous solution or suspension to the solution if a peroxygen-free detergent or cleaning agent is used.

The detergents and cleaning agents, which may be present in the form of granules, pulverulent or tablet-like solids or in the form of other moldings, homogeneous solutions or suspensions can in principle contain all known ingredients customary in such compositions, in addition to said metal complex having a bleach-enhancing effect. The compositions may contain in particular builder substances, surfactants, peroxygen compounds, additional peroxygen activators or organic peracids, water-miscible organic solvents, sequestering agents, enzymes and special additives having a color- and fiber-protecting effect. Further auxiliaries, such as electrolytes, pH regulators, silver corrosion inhibitors, foam regulators and dyes and fragrances, are possible.

A cleaning agent according to the invention for hard surfaces can moreover contain abrasive constituents, in particular quartz powders, woodmeals, plastics powders, chalks and glass microspheres, and mixtures thereof. Abrasives are contained in the cleaning agents preferably in an amount of not more than 20% by weight, in particular from 5 to 15% by weight.

The detergents and cleaning agents may contain one or more surfactants, in particular anionic surfactants, nonionic surfactants and mixtures thereof, but also cationic, zwitterionic and amphoteric surfactants, being suitable. Such surfactants are contained in the detergents according to the invention in proportions of, preferably, from 1 to 50% by weight, in particular from 3 to 30% by weight, whereas cleaning agents for hard surfaces usually contain smaller proportions, i.e. amounts of up to 20% by weight, in particular up to 10% by weight and preferably in the range from 0.5 to 5% by weight. In cleaning agents for use in dishwashing processes in machines, low-foam compounds are usually used.

Suitable anionic surfactants are in particular soaps and those which contain sulfate or sulfonate groups. Suitable surfactants of the sulfonate type are preferably $C_9$–$C_{13}$-alkylbenzenesulfonates, olefinsulfonates, i.e. mixtures of alkene- and hydroxyalkanesulfonates, and disulfonates as obtained, for example, from monoolefins having a terminal or internal double bond by sulfonation with gaseous sulfur trioxide and subsequent alkaline or acidic hydrolysis of the sulfonation products. Alkanesulfonates which are obtained from $C_{12}$–$C_{18}$-alkanes, for example by sulfochlorination or sulfoxidation with subsequent hydrolysis or neutralization are also suitable. The esters of alpha-sulfo fatty acids (estersulfonates), for example the alpha-sulfonated methyl esters of hydrogenated coconut, palm kernel or tallow fatty acids, which are prepared by sulfonation of the methyl esters of fatty acids of vegetable and/or animal origin having 8 to 20 carbon atoms in the fatty acid molecule and subsequent neutralization to give water-soluble mono salts, are also suitable.

Further suitable anionic surfactants are sulfonated fatty acid glyceryl esters, which are mono-, di- and triesters, and mixtures thereof. Preferred alk(en)ylsulfates are the alkali metal and in particular the sodium salts of the sulfuric monoesters of $C_{12}$–$C_{18}$-fatty alcohols, for example obtained from coconut fatty alcohol, tallow fatty alcohol, lauryl, myristyl, cetyl or stearyl alcohol or the $C_8$–$C_{20}$-oxo alcohols and the monoesters of secondary alcohols having this chain length. Alk(en)ylsulfates having said chain length which contain a synthetic, petrochemical-based straight-chain alkyl radical are furthermore preferred. 2,3-Alkylsulfates which are prepared, for example, according to the U.S. Pat. Nos. 3,234,158 and 5,075,041 are also suitable anionic surfactants. The sulfuric monoesters of the straight-chain or branched alcohols ethoxylated with from 1 to 6 mol of ethylene oxide, such as 2-methyl-branched $C_9$–$C_{11}$-alcohols having on average 3.5 mol of ethylene oxide (EO) or $C_{12}$–$C_{18}$-fatty alcohols having 1 to 4 EO, are also suitable.

The preferred anionic surfactants also include the salts of alkylsulfosuccinic acid, which are also referred to as sulfosuccinates or as sulfosuccinic esters, and the monoesters and/or diesters of sulfosuccinic acid with alcohols, preferably fatty alcohols and in particular ethoxylated fatty alcohols. Preferred sulfosuccinates contain $C_8$–$C_{18}$-fatty alcohol radicals or mixtures of these. Fatty acid derivatives of amino acids, for example of N-methyltaurine (taurides) and/or of N-methylglycine (sarcosinates), are suitable as further anionic surfactants. In particular, soaps, for example in amounts of from 0.2 to 5% by weight, are suitable as further anionic surfactants. In particular, saturated fatty acid soaps, such as the salts of lauric acid, myristic acid, palmitic acid, stearic acid, hydrogenated erucic acid and behenic acid, and in particular soap mixtures derived from natural fatty acids, for example coconut, palm kernel or tallow fatty acids, are suitable.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts, in particular in the form of the sodium salts. Anionic surfactants are contained in the detergents according to the invention preferably in amounts of from 0.5 to 10% by weight and in particular in amounts of from 5 to 25% by weight.

Preferably used nonionic surfactants are alkoxylated, advantageously ethoxylated, in particular primary alcohols having, preferably, 8 to 18 carbon atoms and on average 1 to 12 mol of ethylene oxide (EO) per mole of alcohol, in which the alcohol radical may be linear or, preferably, methyl-branched in the 2-position, or may contain a mixture of linear and methyl-branched radicals, as are usually present in oxo alcohol radicals. In particular, however, alcohol ethoxylates having linear radicals obtained from alcohols of natural origin having 12 to 18 carbon atoms, for example from coconut, palmityl, tallow fatty or oleyl alcohol, and on average 2 to 8 EO per mole of alcohol are preferred. The preferred ethoxylated alcohols include, for example, $C_{12}$–$C_{14}$-alcohols having 3 EO or 4 EO, $C_9$–$C_{11}$-alcohols having 7 EO, $C_{13}$–$C_{15}$-alcohols having 3 EO, 5 EO, 7 EO or 8 EO, $C_{12}$–$C_{18}$-alcohols having 3 EO, 5 EO or 7 EO and mixtures of these, such as mixtures of $C_{12}$–$C_{14}$-alcohol having 3 EO and $C_{12}$–$C_{18}$-alcohol having 7 EO. The stated degrees of ethoxylation are statistical average values which may be an integer or a fraction for a specific product. Preferred alcohol ethoxylates have a narrow homolog distribution (narrow range ethoxylates, NRE). In addition to these nonionic surfactants, fatty alcohols having more than 12 EO may also be used. Examples of these are (tallow) fatty alcohols having 14 EO, 16 EO, 20 EO, 25 EO, 30 EO and 40 EO.

The nonionic surfactants also include alkylglycosides of the general formula $RO(G)_x$, in which R is a primary aliphatic radical which is straight-chain or methyl-branched, in particular methyl-branched in the 2-position, and has 8 to 22, preferably 12 to 18 carbon atoms and G is a glycose unit having 5 or 6 carbon atoms, preferably glucose. The degree of oligomerization x, which indicates the distribution of the monoglycosides and oligoglycosides, is an arbitrary number—which, being a quantity to be determined analytically, may also assume fractional values—between 1 and 10; preferably, x is from 1.2 to 1.4. Polyhydroxyfatty acid amides of the formula (I)

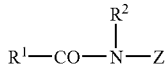

(I)

in which radical $R^1$-CO is an aliphatic acyl radical having 6 to 22 carbon atoms, $R^2$ is hydrogen or an alkyl or hydroxyalkyl radical having 1 to 4 carbon atoms and [Z] is a linear or branched polyhydroxyalkyl radical having 3 to 10 carbon atoms and 3 to 10 hydroxyl groups, are likewise suitable. The polyhydroxy fatty acid amides are preferably derived from reducing sugars having 5 or 6 carbon atoms, in particular from glucose.

The group consisting of the polyhydroxy fatty acid amides also includes compounds of the formula (II)

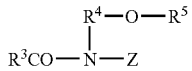

(II)

in which $R^3$ is a linear or branched alkyl or alkenyl radical having 7 to 21 carbon atoms, $R^4$ is a linear, branched or cyclic alkylene radical or an arylene radical having 6 to 8 carbon atoms and $R^5$ is a linear, branched or cyclic alkyl radical or an aryl radical or an oxyalkyl radical having 1 to 8 carbon atoms, $C_1$–$C_4$-alkyl or phenyl radicals being preferred, and [Z] is a linear polyhydroxyalkyl radical whose alkyl chain is substituted by at least two hydroxyl groups, or alkoxylated, preferably ethoxylated or propoxylated, derivates of this radical. Here too, [Z] is preferably obtained by reductive amination of a sugar, such as glucose, fructose, maltose, lactose, galactose, mannose or xylose. The N-alkoxy- or N-aryloxy-substituted compounds can then be converted into the desired polyhydroxy fatty acid amides by reaction with fatty acid methyl esters in the presence of an alkoxide as a catalyst, for example according to WO 95/07331.

A further class of preferably used nonionic surfactants, which are used either as the sole nonionic surfactant or in combination with other nonionic surfactants, in particular together with alkoxylated fatty alcohols and/or alkylglycosides, comprises alkoxylated, preferably ethoxylated or ethoxylated and propoxylated, fatty acid alkyl esters, preferably having 1 to 4 carbon atoms in the alkyl chain, in particular fatty acid methyl esters.

Nonionic surfactants of the amine oxide type, for example N-coconut-alkyl-N,N-dimethylamine oxide and N-tallow-alkyl-N,N-dihydroxyethylamine oxide, and the fatty acid alkanolamides may also be suitable.

From the large group consisting of the cationic surfactants, in particular hydroxyalkylquats of the general structures (III) and (IV) are preferred.

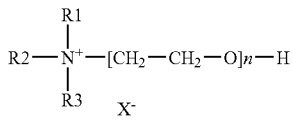

(III)

-continued (IV)

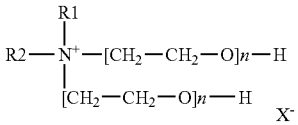

where the radicals R1, R2, R3=$C_1$–$C_{22}$-alkyl and n=1–5.

Further suitable surfactants are Gemini surfactants. These are generally understood as meaning those compounds which have two hydrophilic groups per molecule. These groups are as a rule separated from one another by a spacer. This spacer is as a rule a carbon chain which should be sufficiently long for the hydrophilic groups to have a sufficient spacing so that they can act independently of one another. Such surfactants are generally distinguished by an unusually low critical micelle concentration and the ability greatly to reduce the surface tension of water. However, Gemini polyhydroxy fatty acid amides or poly-polyhydroxy fatty acid amides, as described in WO 95/19953, WO 95/19954 and WO 95/19955, can also be used. Further surfactant types may have dendrimeric structures.

A detergent according to the invention preferably contains at least one water-soluble and/or water-insoluble, organic and/or inorganic builder.

Suitable water-soluble inorganic builder materials are in particular alkali metal silicates and polymeric alkali metal phosphates, which may be present in the form of their alkaline, neutral or acidic sodium or potassium salts. Examples of these are trisodium phosphate, tetrasodium diphosphate, disodium dihydrogen diphosphate, pentasodium triphosphate, so-called sodium hexametaphosphate and the corresponding potassium salts or mixtures of sodium and potassium salts. In particular, crystalline or amorphous alkali metal aluminosilicates, in amounts of up to 50% by weight, are used as water-insoluble, water-dispersible inorganic builder materials. Among these, the crystalline sodium aluminosilicates of detergent quality, in particular zeolite A, P and optionally X, alone or as mixtures, for example in the form of a cocrystallization product of the zeolites A and X, are preferred. Their calcium binding power, which can be determined according to the information in German Patent DE 24 12 837, is as a rule in the range from 100 to 200 mg of CaO per gram. Suitable builder substances are furthermore crystalline alkali metal silicates, which may be present alone or as a mixture with amorphous silicates. The alkali metal silicates which can be used as builders preferably have a molar ratio of alkali metal oxide to $SiO_2$ of less than 0.95, in particular of 1:1.1 to 1:12, and may be present in amorphous or crystalline form. Preferred alkali metal silicates are the sodium silicates, in particular the amorphous sodium silicates having a molar $Na_2O:SiO_2$ ratio of 1:2 to 1:2.8. Those having a molar $Na_2O:SiO_2$ ratio of 1:1.9 to 1:2.8 can be prepared by the process of European Patent Application EP 0 425 427. Crystalline sheet silicates of the general formula $Na_2Si_xO_{2x+1}$ Y $H_2O$, in which x, the modulus, is a number from 1.9 to 4 and y a number from 0 to 20 and preferred values of x are 2, 3 or 4, are preferably used as crystalline silicates, which may be present alone or as a mixture with amorphous silicates. Crystalline sheet silicates which are covered by this general formula are described, for example, in European Patent Application EP 0 164 514. Preferred crystalline sheet silicates are those in which x in said general formula assumes the values 2 or 3. In particular, both α- and β-sodium disilicates ($Na_2Si_2O_5$y $H_2O$) are preferred, it being possible to obtain β-sodium disilicate, for example, by the process which is described in International Patent Application WO 91/08171. β-Sodium silicates having a modulus between 1.9 and 3.2 can be prepared according to Japanese Patent Applications JP 04/238 809 or JP 04/260 610. Virtually anhydrous crystalline alkali metal silicates prepared from amorphous silicates and of the abovementioned general formula in which x is a number from 1.9 to 2.1, which can be prepared as described in the European Patent Applications EP 0 548 599, EP 0 502 325 and EP 0 425 428, can also be used. In a further preferred embodiment of such compositions, a crystalline sodium sheet silicate having a modulus of from 2 to 3 is used, as can be prepared by the process of European Patent Application EP 0 436 835 from sand and sodium carbonate. Crystalline sodium silicates having a modulus in the range from 1.9 to 3.5, as obtainable by the processes of European Patents EP 0 164 552 and/or EP 0 294 753, are used in a further preferred embodiment of compositions according to the invention. In a preferred development of compositions according to the invention, a granular compound of alkali metal silicate and alkali metal carbonate, as described, for example, in International Patent Application WO 95/22592 or as commercially available, for example, under the name Nabion®, is used. If alkali metal aluminosilicate, in particular zeolite, is also present as additional builder substance, the weight ratio of aluminosilicate to silicate is preferably from 1:10 to 10:1, based in each case on anhydrous active substances. In compositions which contain both amorphous and crystalline alkali metal silicates, the weight ratio of amorphous alkali metal silicate to crystalline alkali metal silicate is preferably from 1:2 to 2:1 and in particular from 1:1 to 2:1.

Such builder substances are contained in compositions according to the invention preferably in amounts of up to 60% by weight, in particular from 5 to 40% by weight.

The water-soluble organic builder substances include polycarboxylic acids, in particular citric acid and sugar acids, aminopolycarboxylic acids, in particular methylglycinediacetic acid, nitrilotriacetic acid and ethylenediaminetetraacetic acid, and polyaspartic acid.

Polyphosphonic acids, in particular aminotris(methylenephosphonic acid), ethylenediaminetetrakis(methylenephosphonic acid) and 1-hydroxyethane-1,1-diphosphonic acid, can also be used. Polymeric (poly)carboxylic acids, in particular the polycarboxylates of International Patent Application WO 93/16110 or of International Patent Application WO 92/18542 or of European Patent EP 0 232 202, which are obtainable by oxidation of polysaccharides or dextrins, or polymeric acrylic acids, methacrylic acids, maleic acids and copolymers thereof, which may also contain small amounts of polymerizable substances without a carboxyl functionality incorporated in the form of polymerized units, are also preferred. The relative molar mass of the homopolymers of unsaturated carboxylic acids is in general between 5000 and 200 000 and that of the copolymers between 2000 and 200 000, preferably 50 000 to 120 000, based in each case on free acid. A particularly preferred acrylic acid/maleic acid copolymer has a relative molar mass of 50 000 to 100 000. Commercial products are, for example, Sokalan® CP 5, CP 10 and PA 30 from BASF. Copolymers of acrylic acid or methacrylic acid with vinyl ethers, such as vinyl methyl ethers, vinyl esters, ethylene, propylene and styrene, in which the proportion of the acid is at least 50% by weight, are furthermore suitable. Terpolymers which contain, as monomers, two unsaturated acids and/or salts thereof and, as a third monomer, vinyl alcohol and/or an esterified vinyl alcohol or a carbohydrate can also be used as water-soluble organic builder substances. The first acidic monomer or a salt thereof is derived from a monoethylenically unsaturated $C_3$–$C_8$-carboxylic acid and preferably from a $C_3$–$C_4$-monocarboxylic acid, in particular from (meth)acrylic acid. The second acidic monomer or a salt thereof may be a derivative of a $C_4$–$C_8$-dicarboxylic acid, maleic acid being particularly preferred, and/or a derivative of an allylsulfonic acid which is substituted in the 2-position by an alkyl or aryl radical. Such polymers can be prepared in particular by processes which are described in the German Patents DE 42 21 381 and DE 43 00 772, and generally have a relative molar mass between 1 000 and 200 000. Further preferred copolymers are those which are described in the German Patent Applications DE 43 03 320 and DE 44 17 734 and preferably comprise acrolein and acrylic acid/acrylic acid salts or vinyl acetate as monomers.

The organic builder substances can be used, in particular for the preparation of liquid compositions, in the form of aqueous solutions, preferably in the form of 30 to 50% strength by weight aqueous solutions. All acids mentioned are used as a rule in the form of their water-soluble salts, in particular their alkali metal salts.

Such organic builder substances can, if desired, be contained in amounts of up to 40% by weight, in particular up to 25% by weight and preferably from 1 to 8% by weight. Amounts close to said upper limit are preferably used in pasty or liquid, in particular water-containing, compositions.

Suitable water-soluble builder components in cleaning agents according to the invention for hard surfaces are in principle all builders usually used in compositions for the cleaning of dishes in machines, for example the abovementioned alkali metal phosphates. Their amounts may be in the range of up to about 60% by weight, in particular 5 to 20% by weight, based on the total composition. Further possible water-soluble builder components in addition to polyphosphonates and phosphonate-alkyl carboxylates are, for example, organic polymers of natural and synthetic origin of the abovementioned type of the polycarboxylates, which act as cobuilders particularly in hard water regions, and naturally occurring hydroxycarboxylic acids, such as, for example, mono- or dihydroxysuccinic acid, alpha-hydroxypropionic acid and gluconic acid. The preferred organic builder components include the salts of citric acid, in particular sodium citrate. Anhydrous trisodium citrate and preferably trisodium citrate dihydrate are suitable as sodium citrate. Trisodium citrate dihydrate can be used in the form of a finely or coarsely crystalline powder. Depending on the pH finally established in the cleaning agents according to the invention, the acids corresponding to said cobuilder salts may also be present.

In addition to the complex compounds used according to the invention, conventional bleach activators, i.e. compounds which liberate peroxocarboxylic acids under perhydrolysis conditions, may be used. The customary bleach activators which have O— and/or N-acyl groups are suitable. Polyacylated alkylenediamines, in particular tetraacetylethylenediamine (TAED), acylated glycolurils, in particular tetraacetylglycoluril (TAGU), acylated triazine derivatives, in particular 1,5-diacetyl-2,4-dioxohexahydro-1,3,5-triazine (DADHT), acylated phenylsulfonates, in particular nonanoyl- or isononanoyloxybenzene-sulfonate (NOBS and ISONOBS, respectively), or the amido derivatives thereof, as described, for example, in EP 170 386, acylated polyhydric alcohols, in particular triacetin, ethylene glycol diacetate and 2,5-diacetoxy-2,5-dihydroxyfuran and acetylated sorbitol and mannitol, and acylated sugar derivatives, in particular pentaacetylglucose (PAG), pentaacetylfructose, tetraacetylxylose and octaacetyllactose, and acetylated, optionally N-alkylated glucamine and gluconolactone are preferred. Furthermore, open-chain or cyclic nitrile quats, as disclosed in EP-A 303 520 and WO 98/23602, are suitable for this purpose. The combinations of conventional bleach activators disclosed in German Patent Application DE 44 43 177 can also be used.

The enzymes optionally contained in the compositions according to the invention include proteases, amylases, pullulanases, cellulases, cutinases and/or lipases, for example proteases, such as BLAP®, Optimase®, Opticlean®, Maxacal®, Maxopem®, Durazym®, Purafect® OxP, Esperase® and/or Savinase®, amylases, such as Termamy®, Amylase-LT, Maxamyl®, Duramyl®, Purafectal OxAm, cellulases, such as Celluzyme®, Carezyme®, K-AC® and/or the cellulases and/or lipases discloses in the International Patent Applications WO 96/34108 and WO 96/34092, such as Lipolase®, Lipomax®, Lumafast® and/or Lipozym®. The enzymes used can, as described, for example, in the International Patent Applications WO 92/11347 or WO 94/23005, be adsorbed onto carriers and/or embedded in encapsulating substances in order to protect them from premature deactivation. They are contained in detergents and cleaning agents according to the invention preferably in amounts up to 10% by weight, in particular from 0.05 to 5% by weight, enzymes stabilized to oxidative degradation, as disclosed, for example, in the International Patent Applications WO 94/02597, WO 94/02618, WO 94/18314, WO 94/23053 or WO 95/07350, particularly preferably being used.

Machine dishwashing agents according to the invention preferably contain the customary alkali carriers, such as, for example, alkali metal silicates, alkali metal carbonates and/or alkali metal bicarbonates. The alkali carriers usually used include carbonates, bicarbonates and alkali metal silicates having a molar $SiO_2/M_2O$ (M=alkali metal atom) ratio of from 1:1 to 2.5:1. Alkali metal silicates may be contained in amounts of up to 40% by weight, in particular from 3 to 30% by weight, based on the total composition. The alkali carrier system preferably used in cleaning agents according to the invention is a mixture of carbonate and bicarbonate, preferably sodium carbonate and sodium bicarbonate, which may be contained in an amount of up to 50% by weight, preferably from 5 to 40% by weight.

The invention furthermore relates to a composition for the cleaning of dishes in a machine, comprising from 15 to 65% by weight, in particular from 20 to 60% by weight, of water-soluble builder component, from 5 to 25% by weight, in particular from 8 to 17%-by weight, of oxygen-based bleach, based in each case on the total composition, and from 0.1 to 1% by weight of one or more of the metal complexes defined above. Such a composition preferably has low alkalinity, i.e. its solution, based on percent by weight, has a pH of from 8 to 11.5, in particular from 9 to 11.

In a further embodiment of compositions according to the invention for the automatic cleaning of dishes, from 20 to 60% by weight of water-soluble organic builders, in particular alkali metal citrate, from 3 to 20% by weight of alkali metal carbonate and from 3 to 40% by weight of alkali metal disilicate are contained.

In order to provide protection from silver corrosion, silver corrosion inhibitors can be used in cleaning agents according to the invention for dishes. Preferred silver corrosion inhibitors are organic sulfides, such as cystine and cysteine, dihydric or trihydric phenols, optionally alkyl- or aryl-substituted triazoles, such as benzotriazole, isocyanuric acid, titanium, zirconium, hafnium, molybdenum, vanadium or cerium salts and/or complexes, and salts and/or complexes of the metals contained in the complexes suitable according to the invention with ligands other than those specified in formula (I).

If the compositions foam excessively during use, up to 6% by weight, preferably from about 0.5 to 4% by weight, of a foam-regulating compound, preferably from the group consisting of silicones, paraffins, paraffin-alcohol combinations, silicas which have been rendered hydrophobic, bis-fatty acid amides and mixtures thereof and other known commercially available foam inhibitors may also be added to them. The foam inhibitors, in particular silicone- and/or paraffin-containing foam inhibitors, are preferably bound to a granular water-soluble or water-dispersible carrier substance. In particular, mixtures of paraffins and bistearylethylenediamide are preferred. Further optional ingredients in the compositions according to the invention are, for example, perfume oils.

The organic solvents which can be used in the compositions according to the invention, in particular if they are present in liquid or pasty form, include alcohols having 1 to 4 carbon atoms, in particular methanol, ethanol, isopropanol and tert-butanol, diols having 2 to 4 carbon atoms, in particular ethylene glycol and propylene glycol, and mixtures thereof and the ethers derivable from said classes of compounds. Such water-miscible solvents are present in the cleaning agents according to the invention preferably in an amount of not more than 20% by weight, in particular from 1 to 15% by weight. For establishing a desired pH which does not automatically result through the mixing of the other components, the compositions according to the invention may contain system-compatible and environmentally compatible acids, in particular citric acid, acetic acid, tartaric acid, malic acid, lactic acid, glycolic acid, succinic acid, glutaric acid and/or adipic acid, but also mineral acids, in particular sulfuric acid, or alkali metal hydrogen sulfates, or bases, in particular ammonium or alkali metal hydroxides. Such pH regulators are contained in the compositions according to the invention preferably in an amount of not more than 10% by weight, in particular from 0.5 to 6% by weight.

The compositions according to the invention are preferably present in the form of pulverulent, granular or tablet-like preparations which can be prepared in a manner known per se, for example by mixing, granulation, roll compacting and/or spray-drying of the thermally stable components and admixing of the more sensitive components, which include in particular enzymes, bleach and the bleaching catalyst. Compositions according to the invention in the form of aqueous or other customary solvent-containing solutions are particularly advantageously prepared by simple mixing of the ingredients, which may be introduced as such or in the form of a solution into an automatic mixer.

For the preparation of particulate compositions having a high bulk density, in particular in the range from 650 g/l to 950 g/l, a process disclosed in European Patent EP 0 486 592 and comprising an extrusion step is preferred. A further preferred preparation with the aid of a granulation method is described in European Patent EP 0 642 576. The preparation of compositions according to the invention in the form of non-dusting, storage-stable free-flowing powders and/or granules having high bulk densities in the range from 800 to 1000 g/l can also be effected if, in a first process stage, the builder components are mixed with at least one part of liquid mixing components with an increase in the bulk density of this premix and then—if desired after intermediate drying—the further constituents of the composition, including the bleaching catalyst, are combined with the premix thus obtained. For the preparation of compositions according to the invention in tablet form, it is preferable to adopt a procedure in which all constituents are mixed with one another in a mixer and the mixture is compressed by means of conventional tablet presses, for example eccentric presses or rotary presses, with pressures in the range from 200 $10^5$ Pa to 1 500 $10^5$ Pa. Strong tablets which are nevertheless sufficiently rapidly soluble under the conditions of use and have flexural strengths of, usually, more than 150 N are thus obtained without problems. A tablet produced in this manner preferably has a weight of 1–5 g to 40 g, in particular from 20 g to 30 g, with a diameter of 3–5 mm to 40 mm.

EXAMPLES

Example 1

Synthesis of
bis(butyrolactam)dichloromanganese(II)
$Mn(butyrolact)_2Cl_2$ (Cat1)

45.9 g (0.54 mol) of 2-pyrrolidone (butyrolactam) were added to 300 ml of methanol, after which 33.0 g (0.26 mol) of manganese(II) chloride were added to this solution at 25° C. The reaction was stirred overnight at 25° C., after which the red solution was evaporated to dryness in vacuo. The solid isolated was washed in succession with 50 ml of petroleum ether (30–60° C.) and 50 ml of isopropanol. After drying in vacuo, 79.4 g of the pale brown complex were obtained, which corresponds to complete conversion.

Analytical Data:

Elemental analysis for $C_8H_{12}N_2O_2Cl_2Mn$ (294.0 g/mol): calculated: C 32.7%; H 4.1%; N 9.5%; Cl 24.1%; Mn 18.7% found: C 33.2%; H 5.2%; N 9.3%; Cl 23.4%; Mn 18.0%

Example 2

Synthesis of
bis(ε-caprolactam)dichloromanganese(II)
$Mn(caprolact)_2Cl_2$ (Cat2)

61.1 g (0.54 mol) of E-caprolactam were added to 400 ml of ethanol, after which 33.0 g (0.26 mol) of manganese(II) chloride were added to this solution at 25° C. The reaction was stirred overnight at 25° C., after which the pale brown solution was evaporated to dryness in vacuo. The pale brown solid isolated was washed with 50 ml of petroleum ether (30–60° C.). After drying in vacuo, 94.1 g of the pale brown complex were obtained, which corresponds to complete conversion.

Analytical Data:

Elemental analysis for $C_{12}H_{20}N_2O_2Cl_2Mn$ (350.2 g/mol): calculated: C 41.2%; H 5.8%; N 8.0%; Cl 20.2%; Mn 15.7% found: C 41.6%; H 6.6%; N 8.0%; Cl 19.3%; Mn 14.9%

Example 3

Bleaching Performance

The bleaching performance of the compounds Cat 1 and Cat 2 according to the invention was tested in comparison with the bleach activator TAED. For this purpose, 10 mg/l of the catalyst were dissolved in a wash liquor prepared by dissolving 2 g/l of a bleach-free base detergent (WMP, WFK, Krefeld). After addition of 1 g/l of sodium percarbonate (from Degussa), the washing experiments were carried out in a Linitest apparatus (from Heräcus) at 20 and 40° C. The washing time was 30 min and the water hardness was 18° dH. Tea on cotton (BC-1) and curry on cotton (BC-4, both WFK, Krefeld) served as bleaching test fabric. The difference in reflectance, measured using an Elrepho apparatus, after washing in comparison with the unwashed fabric was evaluated as the bleaching result. As a comparative experiment (V1), in each case 250 mg/l of TAED were used instead of the 10 mg/l of catalyst according to the invention.

| | Difference in reflectance (ddR %) | | | |
|---|---|---|---|---|
| | 20° C. | | 40° C. | |
| Compound | BC-1 | BC-4 | BC-1 | BC-4 |
| Cat 1 | 4.6 | 1.5 | 8.8 | 3.5 |
| Cat 2 | 3.4 | 1.2 | 7.6 | 3.3 |
| TAED(V1) | 2.5 | 1.1 | 4.0 | 2.4 |

It is evident that a significantly better bleaching effect can be achieved by the compounds according to the invention (Cat 1 and Cat 2) than by the conventional bleach activator TAED, which was used in substantially higher concentration (V1). Substantially the same results were obtained when the sodium percarbonate was replaced by sodium perborate.

The invention claimed is:

1. A method of improving the bleaching effect of a peroxygen compound at temperatures below 80 degrees Celsius, said method comprising adding to the peroxygen compound a transition metal complex having a lactam ligand as a bleaching catalyst wherein the transition metal complex has the formula (1)

$$M(L)_nX_m$$

in which

M is a metal atom from the group consisting of Mn, Fe, Co, Ni, Mo, and W, and mixtures thereof, L is a ligand comprising a cyclic carboxamide selected from the group consisting of substituted azetidinone, unsubsitiuted azetidinone, 2 pyrrolidinone, gamma-valerolactam, delta-valerolactam, epsilon-caprolactam, dodecanelactam, pyrrolones, 3-morpholones, hydrocarbostyril, isohydrocarbostyril, benzopiperidone, naphthostyril and, phenanthridone, X is chloride, bromide, nitrate, perchlorate, citrate, hexafluorophosphate or anions of organic acids having $C_1$–$C_{22}$ carbon atoms and n is a number from 2 to 4 and m is a number from 0 to 4.

2. The method of claim 1, wherein the peroxygen compound is selected from the group consisting of organic peracids, hydrogen peroxide, perborate, percarbonate and mixtures thereof.

3. The method of claim 1, wherein the transition metal complex is added with a compound eliminating peroxocarboxylic acid under perhydrolysis conditions.

4. A bleaching composition having an improved bleaching effect at temperatures below 80 degrees Celsius, said bleaching composition comprising a peroxygen compound and a transition metal complex having a lactam ligand as a bleaching catalyst, wherein the transition metal complex has the formula (1)

$$M(L)_nX_m$$

in which

M is a metal atom from the group consisting of Mn, Fe, Co, Ni, Mo, W, and mixtures thereof L is a ligand comprising a cyclic carboxamide selected from the group consisting of substituted azetidinone, unsubsitiuted azetidinone, 2-pyrrolidinone, gamma-valerolactam, delta-valerolactam, epsilon-caprolactam, dodecanelactam, pyrrolones, 3-morpholones hydrocarbostyril, isohydrocarbostyril, benzopiperidone, naphthostyril, and phenanthridone, X is chloride, bromide, nitrate, perchlorate, citrate, hexafluorophosphate or anions of organic acids having $C_1$–$C_{22}$ carbon atoms, and n is a number from 2 to 4 and m is a number from 0 to 4.

5. The bleaching composition as claimed in claim 4, which contains from 0.0025% by weight to 1% by weight of the transition metal complex.

6. The bleaching composition as claimed in claim 4, which, in addition to the transition metal complex, contains from 1% by weight to 10% by weight of a compound eliminating peroxocarboxylic acid under perhydrolysis conditions.

7. A detergent comprising the bleaching composition of claim 4.

8. A cleaning agent comprising the bleaching composition of claim 4.

9. The bleaching composition of claim 4, wherein the transition metal complex comprises from 0.01% to 0.1% by weight of the bleaching composition.

10. The bleaching composition of claim 4, which, in addition to the transition metal complex, contains from 2% by weight to 6% by weight, of a compound eliminating peroxocarboxylic acid under perhydrolysis conditions.

11. A process for cleaning textiles or hard surfaces at temperatures below 80 degrees Celsius, said process comprising contacting textiles or hard surfaces with an aqueous solution comprising the bleaching composition of claim 4.

12. The process of claim 11, wherein the temperature ranges from about 10 to 45° C.

* * * * *